United States Patent [19]

Cochran

[11] Patent Number: 5,048,612

[45] Date of Patent: Sep. 17, 1991

[54] DOUBLE NUT SETTING TOOL AND LINGER HANGER ASSEMBLY

[75] Inventor: Chudleigh B. Cochran, Houston, Tex.

[73] Assignee: Lindsey Completion Systems, Inc., Midland, Tex.

[21] Appl. No.: 579,654

[22] Filed: Sep. 10, 1990

[51] Int. Cl.[5] ..... E21B 23/00; E21B 33/14

[52] U.S. Cl. ..... 166/382; 166/208; 166/216; 166/237

[58] Field of Search ..... 166/382, 208, 216, 217, 166/138, 123, 285, 237, 290

[56] References Cited

U.S. PATENT DOCUMENTS

| | | | |
|---|---|---|---|
| 4,033,640 | 7/1977 | Garcia | 175/325 |
| 4,190,300 | 2/1980 | Scalzi | 175/325 |
| 4,562,889 | 1/1986 | Braddick | 166/381 |
| 4,598,774 | 7/1986 | Bevels et al. | 166/382 |
| 4,688,642 | 8/1987 | Baker | 166/382 |
| 4,712,614 | 12/1987 | Allwin et al. | 166/208 |
| 4,942,925 | 7/1990 | Themig | 166/382 |

*Primary Examiner*—Stephen J. Novosad

[57] ABSTRACT

A setting tool for a liner hanger in an oil well completion system wherein the setting tool mechanism incorporates structure for manipulating a liner prior to and subsequent to hanging the liner hanger in a well casing. Prior to setting the liner hanger the setting tool is locked to a liner hanger by an interconnection with a clutch housing. After hanging the liner hanger, rotation of the setting tool mandrel uncouples the coupling nut from the liner hanger to release the setting tool from the liner hanger and further rotation of the setting tool moves a lock nut to a position when the coupling nut locks the clutch housing to the setting tool so that the liner hanger can be rotated after it is hung in a well casing. The liner hanger and the clutch housing have interengageable clutch surfaces.

22 Claims, 2 Drawing Sheets

DOUBLE NUT SETTING TOOL AND LINGER HANGER ASSEMBLY

RELATED APPLICATIONS

This application is related to Ser. No. 07/579,653, filed Sept. 10, 1990, and entitled Finger Nut Setting Tool and Linger Hanger Assembly; and to Ser. No. 07/579,547, filed Sept. 10, 1990 and entitled Setting Tool and Liner Hanger Assembly.

FIELD OF THE INVENTION

This invention relates to setting tools and liner hangers in oil well completions, and more particularly to a setting tool which can be utilized to rotate a liner either before or after the liner hanger is hung in a well bore.

BACKGROUND OF THE PRESENT INVENTION

During the drilling and completion of an oil well where a borehole traverses earth formations, it is customary to install one or more liners (tubular strings of pipe) in the borehole where the liners are cemented in the borehole by filling the annulus between the liner and the borehole with cement. In installing a liner (which is a string of pipe), the upper end of the liner is connected to a tubular liner hanger which typically has circumferentially arranged exterior slip or wall engaging members where the slip members are in a retracted condition while the liner hanger is lowered into the borehole. The slip members can be set to engage a wall by either hydraulically actuated means or mechanical mechanisms and the liner hanger usually has an interior left-hand thread which is used for releasably coupling the liner hanger to a tubular setting tool. The setting tool has a matching left-hand threaded release nut for coupling with the liner hanger and has a supporting tubular mandrel with a non-circular exterior portion which is slidably but non-rotatably connected in the bore of the release nut. Below the release nut the supporting mandrel has a load supporting cylindrically shaped, upwardly facing shoulder which engages the release nut so that the weight of the liner is carried by the nut on the mandrel shoulder. The upper end of the setting tool mandrel is connected to a string of pipe which is used to lower the liner and the liner hanger into position in the borehole. While lowering the liner into the borehole it is sometimes desirable to rotate the liner in a right hand direction. This requires an ability to impart rotation to the liner hanger through the setting tool without releasing the release nut. This type of rotation can be accomplished by utilizing a set of longitudinal interengaging splines located between the liner hanger and setting tool mandrel in a well known manner.

When a liner hanger is lowered to a position adjacent to the lower end of the next above casing or liner, the slip members on the liner hanger are set to engage with the surrounding pipe wall. Setting of the slip members can be accomplished by hydraulic actuation or by mechanical actuation.

A hydraulically operated liner hanger utilizes hydraulic pressure in the string of pipe and in the setting tool to actuate an axially movable hydraulic cylinder which moves and causes the slip members on the liner hanger to extend outwardly into gripping engagement with the wall of the surrounding casing or liner. In a mechanically actuated liner hanger, a friction block means on the liner hanger frictionally engages a casing or liner so that an interconnecting "J" slot release mechanism can be operated by manipulation of the setting tool to permit the slip members to be set.

If splines are used in the setting tool to enable rotation of a liner prior to the setting of the liner hanger slips, the splines in the setting tool are disengaged after the liner hanger slips are set by longitudinal movement of the supporting string of tubing. The non-circular portion of the mandrel permits longitudinal movement of the setting tool mandrel with the string of tubing. After disengaging the setting tool splines, right-hand rotation of the string of tubing releases the threaded release nut from the interior threaded connection with the liner hanger. The setting tool in a released position in the liner hanger also has pressure sealing means located in the bore of the liner hanger so that the string of tubing is in fluid communication with the bore of the liner. In this condition, before removing the released setting tool from the liner hanger, a cement slurry is pumped down the string of tubing and the liner bore and into the annulus between the liner and the borehole.

The cement slurry which is introduced to the annulus moves upwardly in the annulus between the liner and the borehole. As the cement slurry travels upwardly in the annulus, it displaces the drilling mud in the well bore above the cement. If the liner is reciprocated and/or rotated during the cementing operation, this movement will greatly assist the obtaining of a uniform distribution of the cement in the annulus and proper displacement of the drilling mud in the annulus without channeling of the cement through the mud.

In recent years liner hangers have incorporated a rotatable bearing between horizontal load bearing surfaces in the liner hanger so that when the slips of the liner hanger are set and the liner is suspended by the liner hanger slips from the next above string of well pipe, the liner is supported in the liner hanger on a rotational bearing. The rotational bearing then facilitates rotation of the liner relative to the liner hanger after setting the liner hanger slips. Examples of rotatable load bearing bearings and liner hangers are shown in U.S. Pat. No. 4,033,640 and U.S. Pat. No. 4,190,300.

In order to rotate the liner during the cementing operation, the released setting tool must be coupled to the liner hanger so that rotation of the string of tubing can permit the liner to be rotated as much as desired during the cementing operation. It is desirable that the setting tool remain released from the liner hanger so that it can be pulled out of the well by an upward movement of the drill string at any time during the operation.

Prior art systems for rotating liner hangers and setting tools prior to setting of the slips are well known and typically utilize a single set of splines. In U.S. Pat. No. 4,562,889, and co-pending patent application Ser. No. 609,104, filed May 10, 1984, dual spline arrangements are shown where a second set of splines can be engaged upon release of the release nut so that the liner and setting tool can be co-rotatively rotated while the release nut is released. These systems however require extra spline housing components in the liner hanger and a special setting tool which does not have a universal use.

When the liner hanger for the liner is set in the casing, it is set so the bottom of the cement shoe on the liner is just located above the bottom of the borehole a sufficient distance to eliminate the possibility of fouling of the cement shoe orifices and so that the liner hanger slips can engage the next above casing or liner. As may be appreciated, the cementing operation requires considerable care because once the cement slurry is in the annulus, the liner cannot be removed and repositioned since the cement is already in place. Also, if the releasing mechanism in the setting tool is not disengaged from the liner hanger prior to the cement slurry hardening up, the drill string can be hung up in place. Such malfunctions can result in the loss of well equipment in the well or even destroying the well.

SUMMARY OF THE INVENTION

The present invention involves a setting tool for a liner hanger which incorporates a coupling mechanism for interconnecting the setting tool and the liner hanger prior to and after release of the release nut from a liner hanger. The liner hanger which is connected to a liner is provided at its upper end with a left hand internal threaded section which threadedly receives the release nut on a setting tool and an upwardly facing clutch surface on the end surface of the liner hanger.

The setting tool is adapted for connection with a tubing string or drill string and has a tubular mandrel with an upper longitudinally extending recess located between an upper bearing and an intermediate flange and a lower longitudinally extending recess located between the intermediate flange and a lower load bearing flange. A release nut is slidably and co-rotatively coupled to a lower section in the lower recess. The release nut has an external thread to threadedly connect to the internal threaded section in the liner hanger. The central bore of the release nut is slidably and non-rotatively coupled to a non-circular or spline section of the setting tool mandrel. A tubular clutch housing is slidably mounted on the setting tool mandrel. The clutch housing has a downwardly facing clutch fingers or surfaces which interengage with upwardly facing clutch fingers or surfaces in the top end of the liner hanger. The clutch surfaces can be disengaged by longitudinal movement of the clutch housing in a direction away from the liner hanger. A spring member on the setting tool mandrel is located between the external intermediate flange on the mandrel and an internal flange on the clutch housing and resiliently biases the clutch housing in a downward direction relative to the mandrel. A lock nut is threadedly attached to the setting tool mandrel on a threaded portion located in the upper recess between the intermediate flange and the upper bearing. The lock nut is co-rotatively and slidably coupled to longitudinal slots in the clutch housing.

In a casing and in a condition as described above, the liner hanger is co-rotatable with the setting tool mandrel prior to setting the slips of the liner hanger by virtue of locking nut co-rotatively coupled to the clutch housing, the clutch surfaces between the housing coupling and the top of the liner hanger and a shear pin between the clutch housing and the mandrel. When the liner hanger is in position, the liner hanger slips can be set mechanically or hydraulically when the liner is properly located.

After setting the liner hanger slips, the tubing string and the setting tool mandrel are lowered to shear the shear pin and until the rotatable bearing on the setting tool mandrel engages the clutch housing and holds the clutch surfaces in interengagement. Then, after a given number of rotations of the setting tool mandrel, the release nut is threadedly disengaged from the liner hanger threaded connection by rotation and the setting tool is released or disconnected from the liner hanger. At the same time, further rotation of the setting tool mandrel continues to rotate the lock nut to an upper location relative to the clutch housing where the lock nut jams into the end of the slots in the clutch housing. Thereafter, further rotation rotates the liner hanger through the interengaged clutch surfaces while the liner hanger is set and while the release nut of the setting tool is released from the liner hanger.

IN THE DRAWINGS

DETAILED DESCRIPTION OF THE INVENTION

Figure 1:
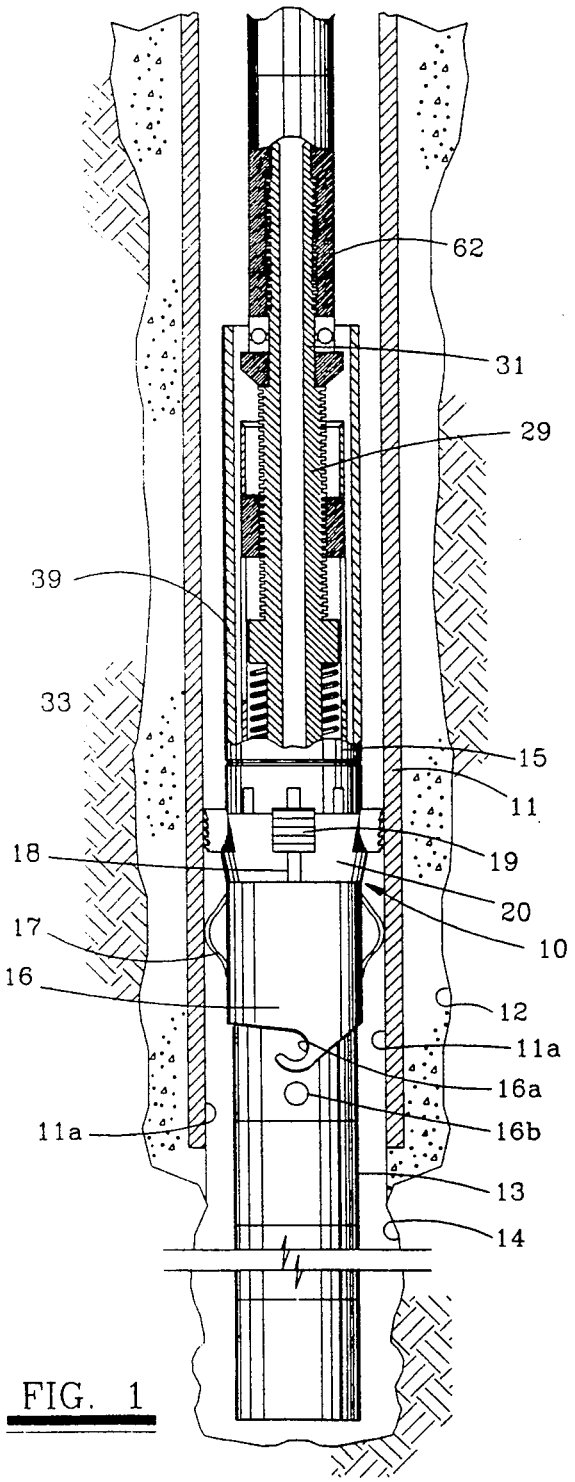
FIG. 1 is an overall schematic view of a liner hanger disposed in a well bore.

Referring now to FIG. 1, a liner hanger assembly 10 is shown in a set position at the lower end of a well casing 11 which has been cemented in a borehole 12. The liner hanger assembly 10 is coupled to a lower depending liner 13 to be cemented in a borehole 14 located below the liner hanger assembly 10.

Figure 2:
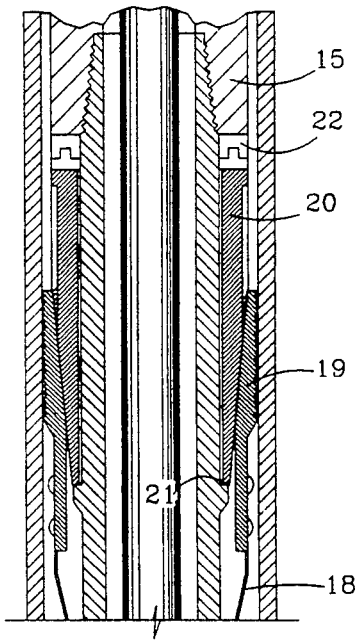
FIG. 2 is a view in longitudinal cross section of the expander cone as related to the supporting member to facilitate ease of rotation.

The liner hanger assembly 10 includes a tubular hanger member 15 which is coupled by a threaded connection to the liner 13. The tubular hanger member 15 carries at its lower end, a tubular J-slot sleeve or cage 16 which has J-hooks or J-slots 16A which are adapted to be releasably connected with respect to J-pins 16B on the hanger member 15. The tubular cage 16 has external friction pads or springs 17 which frictionally engage the interior wall 11A of the casing 11 and prevent the cage 16 from relative rotational movement during the latching or unlatching of the J-pins from the J-hooks. The J-slot cage 16 is attached by longitudinally extending straps 18 to slip members 19 which are circumferentially disposed about the periphery of the hanger member 15. (See also FIG. 2). The slip members 19 have inner tapered surfaces which slide upon an inclined expander cone 20. The expander cone 20 is rotatively mounted on the hanger member 15 between a lower stop shoulder 21 and an upper rotatable bearing 22 (FIG. 2).

Figure 4:
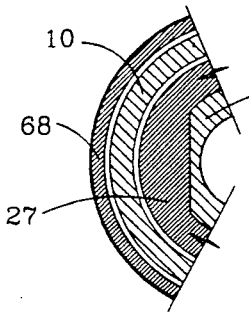
FIG. 4 is an illustration in partial longitudinal cross section taken along line 4—4 of FIG. 3.
Figure 3:
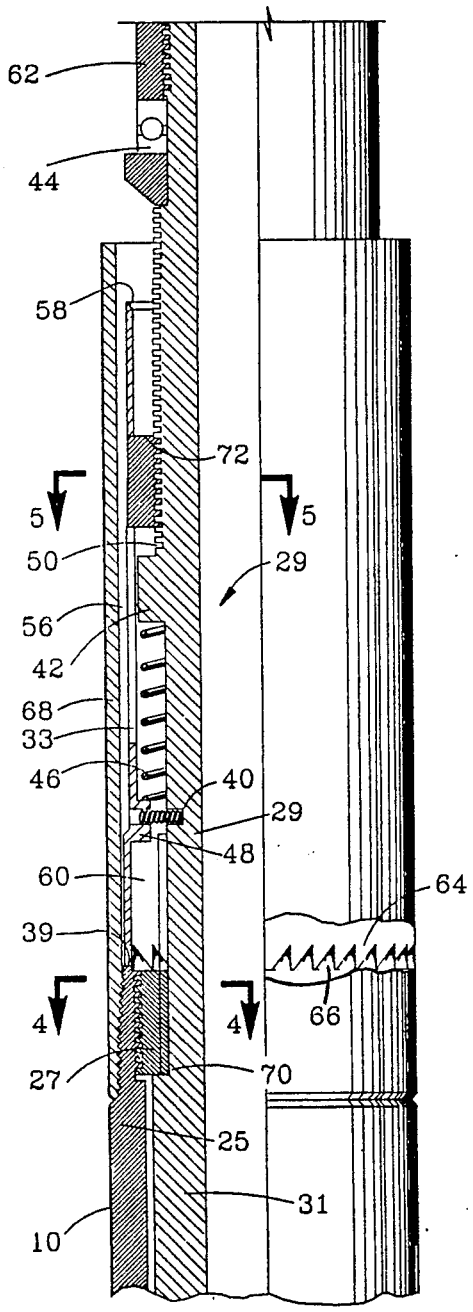
FIG. 3 is an illustration in partial cross section of a setting tool and a liner hanger in a going-in position.
Figure 6:
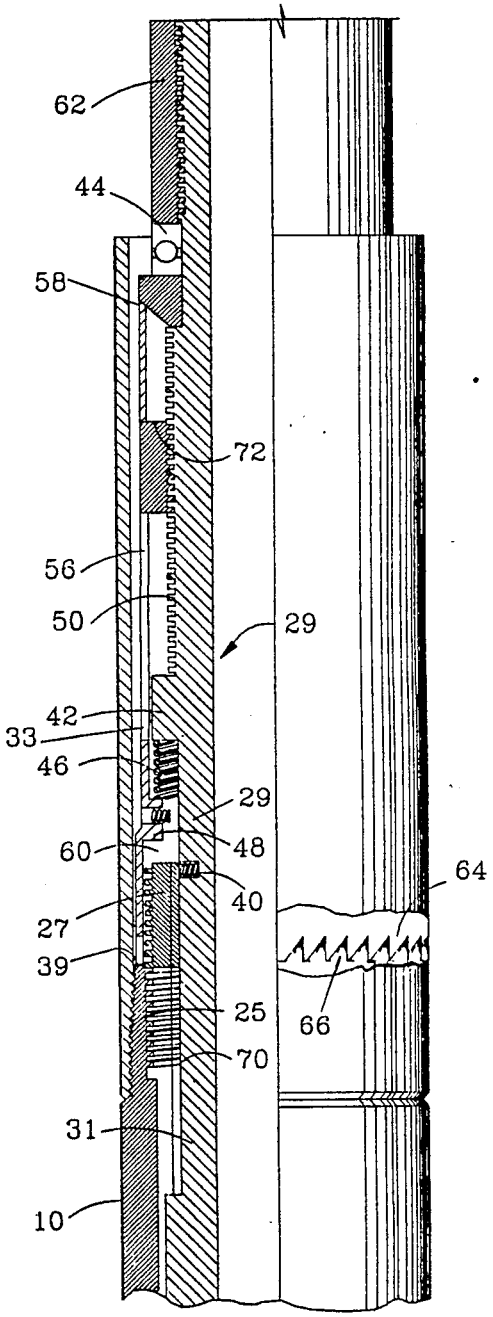
FIG. 6 is an illustration in partial longitudinal cross section of the setting tool assembly of the present invention in a position where the release nut is released and the lock nut is jammed into the clutch housing.

As shown in FIGS. 1 and 3, the liner hanger assembly 10 at its upper end has an internal left-hand thread 25 for threaded coupling to a releasable coupling or release nut 27 on a setting tool mandrel 29. The setting tool mandrel 29 has a slidable but non-rotatable connection with the coupling nut 27 (see FIG. 4) and has a flange 31 below the coupling nut 27 which supports the load of the liner through engagement with the coupling nut 27. A tubular clutch housing 33 is slidably mounted on the setting tool mandrel 29. The clutch housing has clutch surfaces at 39 which mesh with clutch surfaces on the top end of the liner hanger member 15. The clutch housing has longitudinal slots 56 which co-rotatively couple the clutch housing to a lock nut which is connected by a left-hand thread 50 to the setting tool mandrel 29. The clutch housing 33 is connected by a shear pin 40 to the setting tool mandrel 29. In addition, the setting tool mandrel 29 has an intermediate flange 42 located between an upper bearing means 44 and the load supporting flange 31 on the mandrel 29. A spring member 46 is located between the intermediate flange 42 and an internal flange 48 on the clutch housing 33 to maintain the clutch surfaces in engagement at 39. This permits the setting tool mandrel 29 to be rotatively coupled to the liner hanger 10 by the clutch connection 39 while going in a well bore.

Figure 5:
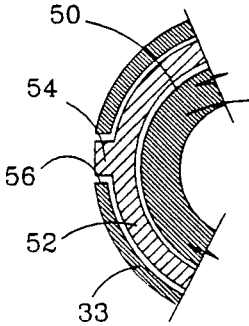
FIG. 5 is an illustration in partial cross section taken along line 5—5 of FIG. 3.

Above the intermediate flange 42 the threaded section 50 extends up to the bearing means 44. The lock nut 52 is threadedly coupled to the threaded section 50 of the mandrel and is spline or lug connected by lugs 54 (see FIG. 5) on the nut 52 to longitudinal slots 56 in the clutch housing. Thus, the lock nut 52 is slidably coupled to the clutch housing 33. Two or more lugs 54 and slots 56 may be circumferentially located in the clutch housing 33.

After setting the slips 19 (shown in FIG. 1), the setting tool mandrel 29 is lowered, which shears the pin 40 between the clutch housing and the setting tool mandrel 29. The mandrel 29 is lowered until the bearing means 44 on the setting tool mandrel 29 engages the upper end 58 of the clutch housing 33. Right-hand rotation of the setting tool mandrel 29 rotates the coupling nut 27 so that the coupling or release nut 27 unthreads and moves upwardly relative to the setting tool mandrel 29. After about ten turns, the coupling nut 27 disengages from its threaded connection with the liner hanger 10 and is received in a recess 60 in the clutch housing 33. When the release nut 27 is located in the recess 60 in the clutch housing 33, two or three additional turns will lock the lock nut 52 in the upper end of the slots 56 in the clutch housing 33. The down weight on the string of tubing 62 is transmitted through the bearing 44 to maintain the clutch surfaces at 39 in engagement and the lock nut 52 in a jamming engagement with the clutch housing 33 enables rotation of the clutch housing 33 and hence the liner 13 can be rotated after the liner hanger slips 19 are set.

As shown in FIG. 3, the upper end of the liner hanger assembly 10 is illustrated with its internal left-hand thread 25 for threaded coupling to the coupling nut 27 of the setting tool. On the upwardly facing internally located end surface of the liner hanger member 15 are circumferentially arranged, upwardly extending clutch surfaces 64 which are arranged in a saw tooth relationship so as to mesh or engage with downwardly facing clutch surfaces 66 on the clutch housing 33. The clutch teeth or surfaces 64,66 can be engaged by moving the surfaces 66 on the clutch housing 33 downward into the surfaces 64 on the hanger member 15. Conversely, the surfaces 64,66 can be disengaged from one another by longitudinally moving the clutch housing 33 in an upward direction relative to the hanger member 15. A tubular guide housing 68 may be threadedly coupled to the upper end of the liner hanger member 15 to protect the surfaces 66 and provide a guiding function.

The setting tool as illustrated in FIG. 3 includes the setting tool mandrel 29 which has the coupling nut 27 which is normally seated on the load supporting flange 31. The coupling nut 27 has an external left-hand machine thread and an internal bore 70 with a non-circular cross section which slidably and co-rotatively receives a non-circular cross section of a length of the mandrel 29.

The setting tool is assembled with the liner hanger as shown in FIG. 3, with the threaded coupling nut 27 in threaded engagement with the threads 25 on the liner hanger; the clutch surfaces 66 on the clutch housing 33 in engagement with the clutch surfaces 64 on the liner hanger; and the lock nut 52 in the clutch housing 33 in engagement with the upper ends of the slots 56 of the clutch housing. As such, the setting tool, liner hanger and liner can be lowered into the well bore by a tubing string to the desired location. At any time rotation and/or reciprocation of the tubing string will produce rotation or reciprocation of the liner without affecting the setting tool coupling arrangement. The spring member 46 will ordinarily maintain the clutch surfaces in engagement. However, the shear pin 40 provides added assurance of a proper coupling relationship. The setting tool has the intermediate flange 42 located above the internal flange 48 on the clutch housing so that the spring member 46 can positively urge the clutch housing into the clutch connection at 39.

At a desired location in the well bore, the liner hanger slips are set to hang the liner in the well bore and support the weight of the liner on the liner hanger slips. Next the tubing string is slacked off (lowered) to release the shear pin interconnection with the clutch housing 33. The tubing string 62 is lowered until the bearing 44 on the setting tool mandrel 29 engages the clutch housing 33 and weight is applied to maintain the clutch surfaces 64,66 at 39 in engagement. Following this downward stroke, the tubing string is rotated in a right-hand direction to rotate the release nut 27. The release nut 27 unscrews from the threaded connection with the liner hanger and moves upwardly in the internal recess 60 in clutch housing 33. At the same time the lock nut 52 coupled to the clutch housing 33 moves upwardly on the setting tool mandrel 29. The arrangement is such that the release nut 27 uncouples from the liner hanger 15 prior to the lock nut 52 engaging the end surfaces 72 in the slots 56 in the clutch housing 33. After the release nut 27 is free or released from the liner hanger thread 25, further rotation causes the lock nut 52 to engage the end surfaces 72 in the clutch housing slot 56. This engagement of the lock nut 52 locks the mandrel 29 to the clutch housing 33. Since the clutch housing 33 is coupled by the clutch surfaces 64,66 to the liner hanger, rotation of the mandrel 29 rotates the liner hanger and liner after the liner hanger is set and while the setting tool is released from the liner hanger. Thus, if a complication arises during cementing, the operator can pull up and retrieve the setting tool and tubing string from the liner.

It will be apparent to those skilled in the art that various changes may be made in the invention without departing from the spirit and scope thereof and therefore the invention is not limited by that which is enclosed in the drawings and specifications, but only as indicated in the appended claims.

I claim:

1. In a setting tool and liner hanger system for use in rotating a liner hanger prior to and subsequent to setting of a liner hanger, a setting tool and liner hanger including:

said liner hanger being tubular and having an internal threaded coupling for releasable coupling to a setting tool, said liner hanger having means for hanging a liner in a well;

said setting tool having an external threaded nut on a setting tool mandrel for releasable coupling to said internal threaded coupling in said liner hanger;

first coupling means on said setting tool including a clutch housing for releasably coupling to said liner hanger for imparting rotation thereto when said clutch housing is coupled to said setting tool mandrel; and second coupling means for co-rotatively coupling said clutch housing to said setting tool mandrel, said second coupling means being operable upon release of said external threaded nut from said liner hanger.

2. The apparatus as set forth in claim 1 wherein said first coupling means includes interengaging clutch surfaces on said clutch housing and said liner hanger.

3. The apparatus as set forth in claim 1 wherein said second coupling means includes an annular member having a slidable and non-rotative interconnection with one of said clutch housing and said setting tool mandrel, said annular member having a threaded connection with the other of said clutch housing and said setting tool mandrel.

4. The apparatus as set forth in claim 3 wherein said first coupling means includes interengaging clutch surfaces on said clutch housing and said liner hanger.

5. The apparatus as set forth in claim 1 and further including third coupling means for releasably co-rotatively coupling said clutch housing to said setting tool mandrel prior to release of said external threaded nut from said liner hanger.

6. In a setting tool system for use in rotating a liner hanger prior to and subsequent to setting of a liner hanger, a setting tool having liner hanger coupling means for releasable coupling to a liner hanger; and first coupling means on said setting tool including a clutch housing for releasably coupling to a liner hanger for imparting rotation thereto when said clutch housing is coupled to said setting tool mandrel; and second coupling means for co-rotatively coupling said clutch housing to said setting tool mandrel, said second coupling means being operable upon release of said liner hanger coupling means from a liner hanger.

7. The apparatus as set forth in claim 6 wherein said first coupling means includes clutch surfaces on said clutch housing for interengagement with a liner hanger.

8. The apparatus as set forth in claim 6 wherein said second coupling means includes an annular member having a slidable and non-rotative interconnection with one of said clutch housing and said setting tool mandrel, said annular member having a threaded connection with the other of said clutch housing and said setting tool mandrel.

9. The apparatus as set forth in claim 8 wherein said first coupling means includes clutch surfaces on said clutch housing for interengagement with a liner hanger.

10. The apparatus as set forth in claim 6 and further including third coupling means for releasably co-rotatively coupling said clutch housing to said setting tool mandrel prior to release of said liner hanger coupling means from a liner hanger.

11. A setting tool and liner hanger system for enabling rotation of a liner hanger and attached liner through rotation of a setting tool and an attached string of tubing prior to and subsequent to setting of a liner hanger, said system including:

a liner hanger having an internal coupling thread at one end thereof, and having wall engaging means for gripping a casing wall to suspend a liner in a well bore and having a liner hanger clutch means;

a setting tool having a load supporting tubular mandrel with a coupling nut having an external coupling thread to releasably couple the setting tool to the internal coupling thread on said liner hanger, said coupling nut being slidably and co-rotatively coupled to said mandrel;

a clutch housing slidably disposed on said mandrel, said clutch housing having housing clutch means for releasably engaging said liner hanger clutch means, said clutch housing having an internal recess means above said coupling nut, a lock nut disposed in said recess means for longitudinal non-rotative movement, said lock nut being threadedly connected to said setting tool mandrel;

said clutch housing and said setting tool mandrel having a co-rotative and longitudinally slidable interconnection so that said liner hanger can be rotated with said setting tool prior to release of said setting tool from said liner hanger; and said mandrel being rotatable relative to said clutch housing for enabling rotation of said coupling nut relative to said liner hanger to release said coupling nut from said liner hanger and to lock said lock nut within said clutch housing so that said mandrel can rotate said liner hanger after release of said coupling nut from said liner hanger.

12. The apparatus as set forth in claim 11 wherein said clutch means includes interengaging surfaces on said clutch housing and said liner hanger.

13. A setting tool for setting a liner hanger in a well bore where the liner hanger is adapted for coupling to a liner and the setting tool is adapted for coupling to a string of pipe extending to the earth's surface, said setting tool including:

an elongated, tubular setting tool mandrel having a load supporting flange portion;

a tubular clutch housing slidably disposed on said setting tool mandrel and having an internal recess portion as well as coupling means for slidably mounting a lock nut in for longitudinal movement in said clutch housing;

a coupling nut member slidably and non-rotatively mounted on said mandrel, said coupling nut member having an exterior thread for threaded coupling to an internal threaded portion of a liner hanger;

said clutch housing having clutch means for releasably engaging a liner hanger, said lock nut being threadedly coupled to said setting tool mandrel;

first means for retaining said clutch means in a clutch engaging position in a first longitudinal position of said mandrel relative to said clutch housing; and second means for retaining said clutch means in a clutch engaging position in a second longitudinal position of said mandrel relative to said clutch housing so that said coupling nut can be threadedly released from the liner hanger and said lock nut can lock up in said clutch housing in said second longitudinal position.

14. The apparatus as set forth in claim 13 wherein said first retaining means includes a spring member for engaging said clutch housing with a liner hanger in said first longitudinal position.

15. The apparatus as set forth in claim 13 wherein said first retaining means includes a shear pin.

16. The apparatus as set forth in claim 13 wherein said second means includes bearing means on said seting tool mandrel for engaging said clutch housing in said second longitudinal position.

17. The apparatus as set forth in claim 13 wherein said lock nut is arranged in said clutch housing so that the lock nut engages an end surface in said clutch housing after said coupling nut member is released from a liner hanger.

18. The apparatus as set forth in claim 13 wherein said clutch means are disengagable upon relative movement of said clutch housing away from a liner hanger.

19. A liner hanger for use in hanging liners in a well bore and for permitting rotation after a liner hanger is set in a well casing, said liner hanger including;

a tubular member having an internally threaded portion for releasable connection to a setting tool nut, said tubular member having an upwardly facing end surface having a shaped surface to define clutch surfaces;

support means on said tubular member for engaging the wall of a well casing for hanging a liner in a well casing; and rotative connection means between said support means and said tubular member for permitting rotation of the tubular member relative to the support means.

20. A method of hanging and rotating a liner in a well casing during a completion operation comprising the steps of:

lowering a setting tool and a liner hanger into a well bore where the setting tool is attached to a string of pipe and the liner hanger is attached to a liner and where the setting tool is releasably coupled to the liner hanger and a setting tool mandrel is releasably co-rotatively locked to the liner hanger to prevent rotation;

upon reaching a desired setting location in a well bore, hanging the liner hanger in the well to support the weight of the liner and to permit rotation of the liner;

manipulating the string of pipe to a position to permit relative rotation between the setting tool mandrel and the liner hanger;

rotating the setting tool mandrel to effect a released and uncoupled condition of the setting tool mandrel relative to the liner hanger;

after releasing the setting tool mandrel from the liner hanger, rotating the setting tool mandrel to a position where the setting tool mandrel is co-rotatively locked relative to the liner hanger while remaining released and uncoupled; and applying weight to the string of pipe to maintain a co-rotative coupling of the setting tool mandrel and the liner hanger so that the liner can be rotated by rotation of the string of pipe while the setting tool is released and uncoupled.

21. A method of hanging and rotating a liner in a well casing during a completion operation comprising the steps of:

lowering a setting tool and a liner hanger into a well bore where the setting tool is attached to a string of pipe and the liner hanger is attached to a liner and where the setting tool is releasably coupled to the liner hanger by a coupling nut threadedly connected to the liner hanger and the setting tool is releasably co-rotatively locked to the liner hanger for co-rotation;

upon reaching a desired setting location in a well bore, hanging the liner hanger in the well to support the weight of the liner and to permit rotation of the liner;

manipulating the string of pipe to release the co-rotative coupling;

rotating the string of pipe to move the coupling nut to a released and uncoupled condition relative to the liner hanger rotating the string of pipe additionally to co-rotatively lock the setting tool and liner hanger to one another while the setting tool is released and uncoupled; and applying weight to the string of pipe to engage while the setting tool is released and uncoupled so that the liner can be rotated by rotation of the string of pipe.

22. A method of hanging and rotating a liner in a well casing during a completion operation comprising the steps of:

lowering a setting tool and a liner hanger into a well bore where the setting tool is attached to a string of pipe and the liner hanger is attached to a liner and where the setting tool is releasably coupled to the liner hanger by a nut means threadedly connected to the liner hanger., upon reaching a desired setting location, hanging the liner hanger in the well to support the weight of the liner and to permit rotation of the liner;

manipulating the string of pipe to simultaneously rotate the nut means to a released condition relative to the liner hanger while rotating a lock nut in a clutch housing into a locking position in the clutch housing to engage said clutch housing with the liner; and applying weight to the string of pipe to engage said clutch housing with the liner when the coupling nut is released and the lock nut is in a locking position so that the liner can be rotated by rotation of the string of pipe after the coupling nut is released.

* * * * *